US009028039B2

(12) United States Patent
Masaoka et al.

(10) Patent No.: US 9,028,039 B2
(45) Date of Patent: May 12, 2015

(54) IMAGE FORMING APPARATUS

(71) Applicants: Shingo Masaoka, Kanagawa (JP); Shotaro Takeuchi, Kanagawa (JP); Masahiko Hisada, Kanagawa (JP)

(72) Inventors: Shingo Masaoka, Kanagawa (JP); Shotaro Takeuchi, Kanagawa (JP); Masahiko Hisada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/507,929

(22) Filed: Oct. 7, 2014

(65) Prior Publication Data

US 2015/0097894 A1 Apr. 9, 2015

(51) Int. Cl.
*B41J 2/165* (2006.01)

(52) U.S. Cl.
CPC ..... *B41J 2/16579* (2013.01); *B41J 2/16535* (2013.01)

(58) Field of Classification Search
CPC ..... B41J 2/07; B41J 2/16526; B41J 2/1652; B41J 3/543; B41J 29/38; B41J 29/393; B41J 2/16517
USPC ..... 347/14, 22, 23, 29, 33–36, 60, 89–90
See application file for complete search history.

(56) References Cited

U.S. PATENT DOCUMENTS 6,619,783 B2 * 9/2003 Kanaya et al. ..... 347/35
2014/0132668 A1 5/2014 Takeuchi

FOREIGN PATENT DOCUMENTS

JP 2004-306475 11/2004
JP 2007-50533 3/2007
JP 2010-264381 11/2010

* cited by examiner

*Primary Examiner* — Thinh Nguyen
(74) *Attorney, Agent, or Firm* — Cooper & Dunham LLP

(57) ABSTRACT

An image forming apparatus includes a recording head, an ejection detector, a cleaner and cleaning ejection controller. The ejection detector has a droplet landing member disposed in an area in which the droplet landing member faces the head. The ejection detector detects ejection or non-ejection by detecting electric change caused by landing of the droplets on the droplet landing member. The cleaner cleans a droplet landing surface of the droplet landing member. The cleaning ejection controller controls the recording head to eject droplets on the droplet landing surface for cleaning the droplet landing surface before cleaning the droplet landing surface by the cleaner. A quantity of the droplets for cleaning the droplet landing surface is greater than a quantity of the droplets for detecting ejection or non-ejection.

10 Claims, 11 Drawing Sheets

IMAGE FORMING APPARATUS

CROSS-REFERENCE TO RELATED APPLICATION

This patent application is based on and claims priority pursuant to 35 U.S. §119 to Japanese Patent Application No. 2013-210064, filed on Oct. 7, 2013, in the Japan Patent Office, the entire disclosure of which is hereby incorporated by reference herein.

BACKGROUND

1. Technical Field

This disclosure relates to an image forming apparatus.

2. Description of the Related Art

Image forming apparatuses are used as printers, facsimile machines, copiers, plotters, or multi-functional devices having at least one of the foregoing capabilities. As one type of image forming apparatus employing a liquid-ejection recording method, inkjet recording apparatuses are known that use a recording head (liquid ejection head or liquid-droplet ejection head) for ejecting droplets of ink or other liquid.

For example, a liquid-ejection type image forming apparatus has an ejection detector to detect a state of droplet ejection from a recording head. When faulty droplet ejection is detected on a nozzle(s), the image forming apparatus performs maintenance and recovery operation (maintenance operation) on the recording head, such as cleaning of a nozzle face.

For example, an ejection detector detects ejection or non-ejection by measuring an electric change when liquid droplets ejected from a recording head land on an electrode board.

For example, such an electrode board is cleaned by a wiping member which wipes the plate in the same direction as a moving direction of a carriage.

For the above-described configuration in which detection or non-detection is detected based on an electric change generated by liquid droplets ejected onto a droplet landing member, e.g., an electrode board, liquid droplets adhere to the droplet landing member in the detection of droplet ejection. Thus, as above-described, wiping for cleaning on the liquid droplet landing member is performed by a wiping member.

However, the liquid waste fluid which adhered to the droplet landing member solidifies and a droplet landing surface cannot be cleaned only by wiping with the wiping member. As a result, it becomes impossible to perform high-precision detection of droplet ejection.

BRIEF SUMMARY

In at least one exemplary embodiment of this disclosure, there is provided an image forming apparatus including a recording head, an ejection detector, a cleaner, and a cleaning ejection controller. The recording head has a plurality of nozzles to eject droplets. The ejection detector is configured to detect the droplets from the recording head, and includes a droplet landing member, onto which the droplets ejected from the plurality of nozzles of the recording head lands, and which is disposed in an area where the recording head faces. In an aspect of this disclosure, the ejection detector is configured to detect ejection or non-ejection of the droplets by detecting electric change caused by landing of the droplets on the droplet landing member, and the cleaner cleans a droplet landing surface of the droplet landing member in the ejection detector. When cleaning the droplet landing surface by the cleaner, the cleaning ejection controller controls the recording head to eject droplets for cleaning to the droplet landing surface before the cleaner starts cleaning.

In another aspect, the ejection controller controls droplet ejection such that a quantity of the droplets for cleaning is more than a quantity of the droplets for detecting ejection or non ejection of the droplets.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
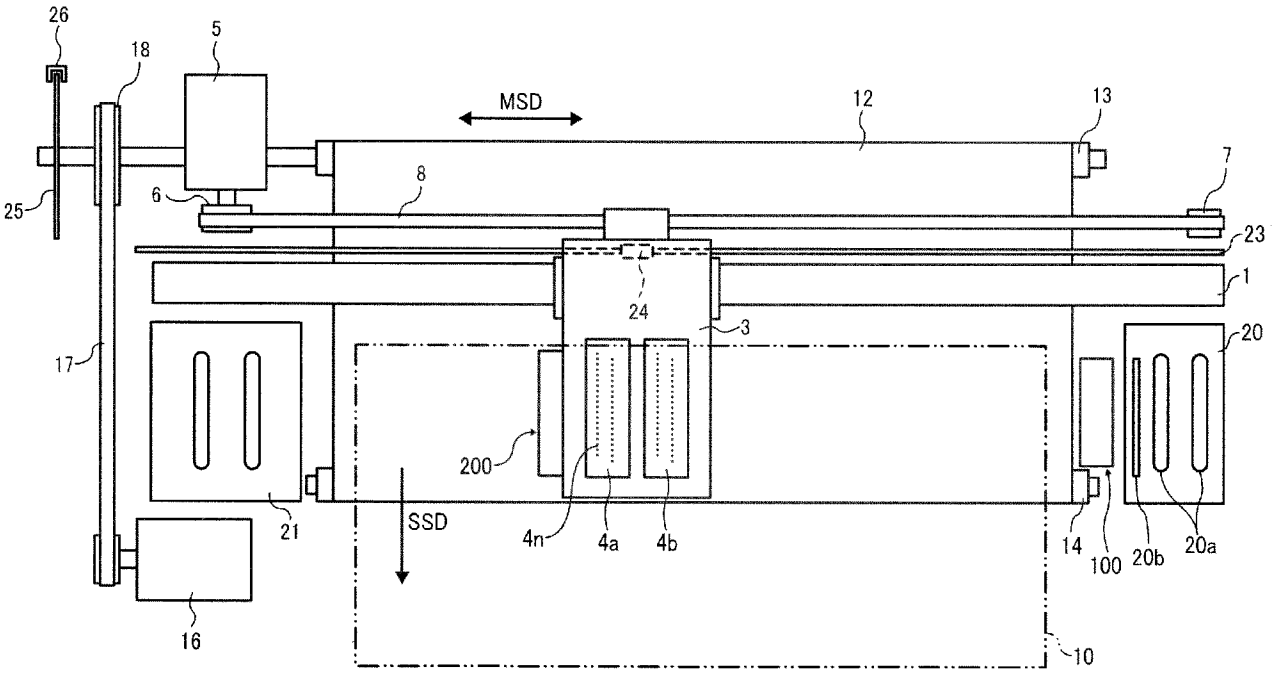
FIG. 1 is a plan view of a mechanical section of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid onto a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense (i.e. necessarily with a colorant), unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally formed image.

The term "electric change" used herein is used broadly to include change of any of various electrical properties, such as but not limited to, conductance properties, resistance properties, and so on.

Although the exemplary embodiments are described with technical imitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Next, an image forming apparatus according to some exemplary embodiments of the present disclosure is described below with reference to FIG. 1.

FIG. 1 is a partial plan view of a mechanical section of an image forming apparatus according to an exemplary embodiment of the present disclosure.

In FIG. 1, the image forming apparatus is a serial-type inkjet recording apparatus. In the image forming apparatus, a carriage 3 is supported by a main guide rod 1 and a sub guide rod so as to be movable in a direction (main scanning direction) indicated by an arrow MSD in FIG. 1. The main guide rod 1 and the sub guide rod extend between left and right side plates. A main scanning motor 5 reciprocally moves the carriage 3 for scanning in the main scanning direction MSD via a timing belt 8 extending between a driving pulley 6 and a driven pulley 7.

The carriage 3 mounts recording heads 4*a* and 4*b* (collectively referred to as "recording heads 4" unless distinguished) serving as liquid ejection heads for ejecting liquid droplets. The recording heads 4 eject, for example, ink droplets of respective colors, such as yellow (Y), cyan (C), magenta (M), black (K), etc. The carriage mounts the recording heads 4 so that nozzle rows, each of which includes multiple nozzles 4*n*, are arranged in a sub scanning direction (indicated by an arrow SSD in FIG. 1) perpendicular to the main scanning direction MSD and ink droplets are ejected downward from the nozzles.

Figure 2:
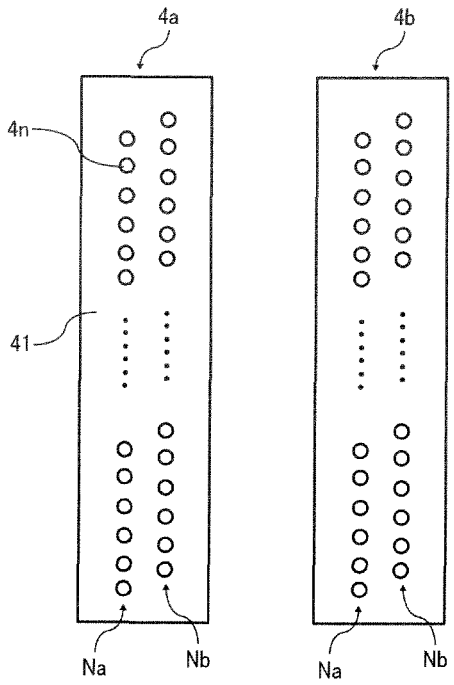
FIG. 2 is a schematic view of recording heads of an image forming apparatus according to an exemplary embodiment of the present disclosure.

As illustrated in FIG. 2, each recording head 4 has two nozzle rows Na and Nb, each of which is formed of multiple nozzles 4*n*. For example, one (nozzle row Na) of the nozzle rows of the recording head 4*a* ejects droplets of black (K), and the other (nozzle row Nb) ejects droplets of cyan (C). One (nozzle row Na) of the nozzle rows of the recording head 4*b* ejects droplets of magenta (M), and the other (nozzle row Nb) ejects droplets of yellow (Y).

For example, piezoelectric actuators such as piezoelectric elements, or thermal actuators that generate film boiling of liquid (ink) using electro/thermal converting elements (such as heat-generation resistant bodies) to cause a phase change, may be employed as the liquid ejection heads forming the recording heads 4.

The image forming apparatus has a conveyance belt 12 serving as a conveyance device to convey a sheet 10 at a position opposing the recording heads 4 while adhering the sheet 10 thereon by static electricity. The conveyance belt 12 is an endless belt that is looped between a conveyance roller 13 and a tension roller 14.

The conveyance roller 13 is rotated by a sub-scanning motor 10 via a timing belt 17 and a tinting pulley 18 to circulate the conveyance belt 12 in the sub-scanning direction SSD illustrated in FIG. 1. A charging roller charges (supplies electric charges to) the conveyance belt 12 during circulation.

At one end in the main scanning direction MSD of the carriage 3, a maintenance assembly (maintenance-and-recovery assembly) 20 is disposed near a lateral side of the conveyance belt 12 to perform maintenance and recovery on the recording heads 4. At the opposite end in the main scanning direction MSD, a first dummy ejection receptacle 21 is disposed at the opposite lateral side of the conveyance belt 12 to receive liquid droplets ejected from the recording heads 4 by dummy ejection in which liquid droplets not contributing to image formation are ejected for maintenance, e.g., removal of viscosity-increased liquid or bubbles.

The maintenance assembly 20 includes cap members 20*a* to cap, for example, nozzle faces (nozzle formed faces) of the recording heads 4, a wiper member 20*b* to wipe the nozzle faces, and a second dummy ejection receptacle to store liquid droplets not contributing to image formation.

An ejection detection unit 100 according to an exemplary embodiment of the present disclosure is disposed in an area outside a recording region between the conveyance belt 12 and the maintenance assembly 20, in which the ejection detection unit 100 can oppose the recording heads 4. The carriage 3 has a cleaning unit 200 to clean an electrode board 101 of the ejection detection unit 100.

An encoder scale 23B having a predetermined pattern extends between the side plates along the main scanning direction MSD of the carriage 3, and the carriage 3 has a main-scanning encoder sensor 24 serving as a transmissive photosensor to read the pattern of the encoder scale 23. The encoder scale 23 and the main-scanning encoder sensor 24 form a linear encoder (main scanning encoder) to detect movement of the carriage 3.

A code wheel 25 is mounted on a shaft of the conveyance roller 13, and a sub-scanning encoder sensor 26 serving as a transmissive photosensor is provided to detect a pattern of the code wheel 25. The code wheel 25 and the sub-scanning encoder sensor 26 form a rotary encoder (sub scanning encoder) to detect the movement amount and movement position of the conveyance belt 12.

In the image forming apparatus having the above-described configuration, a sheet 10 is fed from a sheet feed tray, attached on the conveyance belt 12 charged, and conveyed in the sub-scanning direction SSD with the circulation of the conveyance belt 12. By driving the recording heads 4 in response to image signals while moving the carriage 3 in the main scanning direction MSD, ink droplets are ejected onto the sheet 10 stopped to form one line of a desired image. Then, the sheet 10 is fed by a certain distance to prepare for the next operation to record another line of the image. Receiving a signal indicating that the image recording has been completed or a rear end of the sheet 10 has arrived at the recording region, the image forming apparatus finishes the recording operation and outputs the sheet 10 to a sheet output tray.

Next, an outline of a controller of the image forming apparatus according to an exemplary embodiment is described with reference to FIG. 3.

Figure 3:
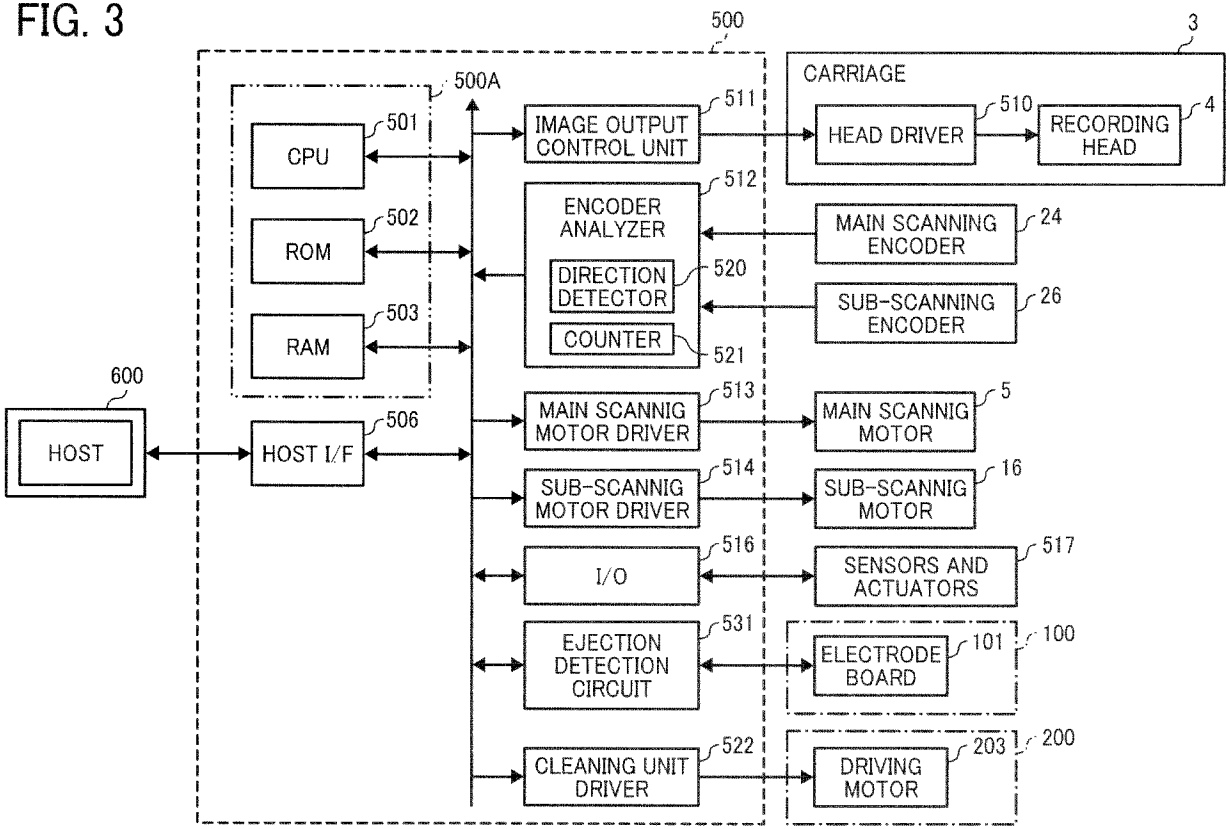
FIG. 3 is a block diagram of a controller of an image forming apparatus according to an exemplary embodiment of the present disclosure.

FIG. 3 is a block diagram of a controller 500 of the image forming apparatus.

The controller 500 has a main control unit 500A. The main control unit 500A includes a central processing unit (CPU) 501, a read-only memory (ROM) 502, and a random access memory (RAM) 503. The CPU 501 controls the entire image forming apparatus. The ROM 502 stores programs executed by the CPU 501 and other fixed data. The RAM 503 temporarily stores image data and other data.

The controller 500 has a host interface (I/F) 506 to transmit and receive data to and from a host (e.g., information processing device) 600, such as a personal computer (PC), an image output control unit 511 to control driving of the recording heads 4, and an encoder analyzer 512. The encoder analyzer 512 receives and analyzes detection signals from the main-scanning encoder sensor 24 and the sub-scanning encoder sensor 26.

The controller 500 includes a main-scanning motor driver 513 to drive the main scan motor 5, a sub scanning motor driver 514 to drive the sub-scanning motor 16, and an input/output (I/O) unit 516 between various sensors and actuators 517.

The controller 500 also includes an ejection detection circuit 531 to measure (detect) electric changes caused when liquid droplets land on an electrode hoard 101 of the ejection detection unit 100 to determine ejection or non-ejection. The controller 500 further includes a cleaning unit driver 522 to drive a driving motor 203 of the cleaning unit 200 to wipe the electrode board 101 of the ejection detection unit 100.

Figure 4:
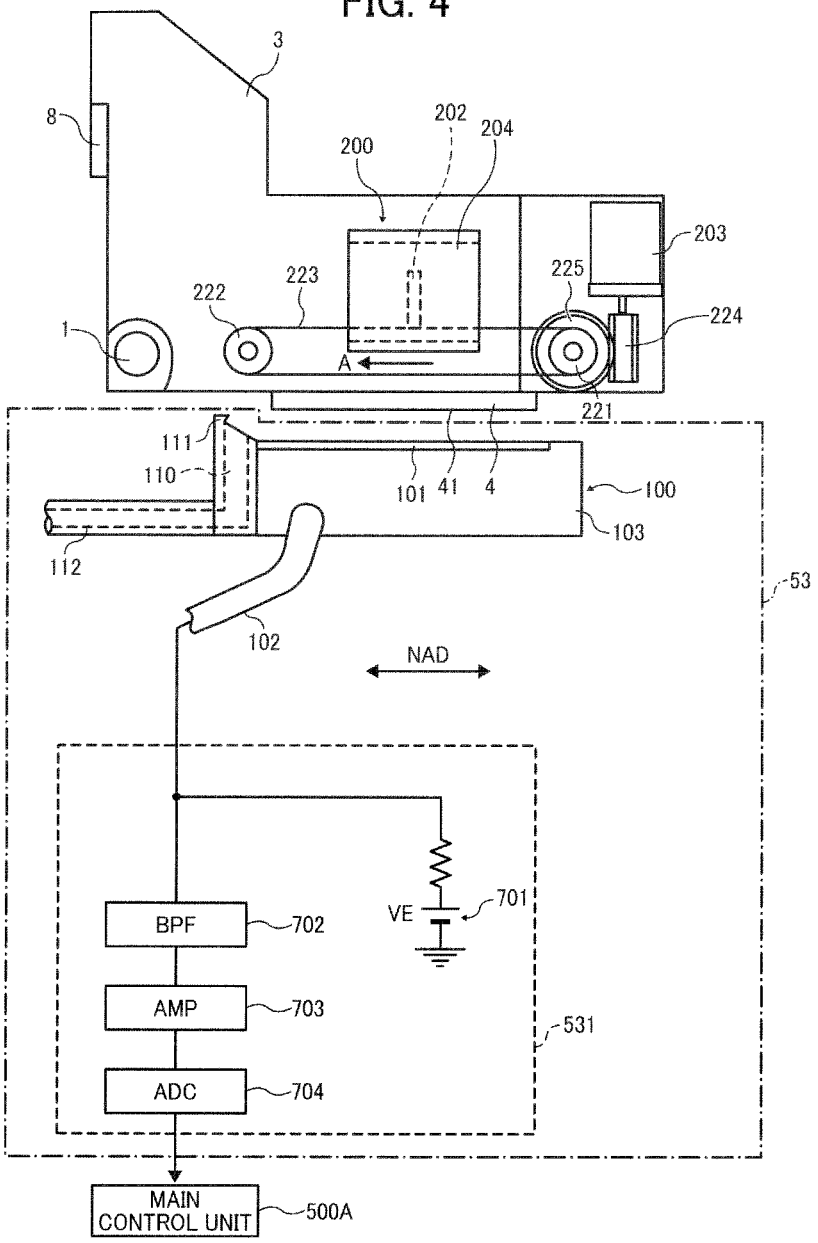
FIG. 4 is a schematic view of lateral faces of a carriage section and an ejection detection unit and a block circuit of an ejection detection unit according to an exemplary embodiment of the present disclosure.

In the example shown in FIG. 4, ejection detector 53 includes ejection detection circuit 531 and ejection detection unit 100. As one should appreciate, the ejection detector may include additional components (not shown in FIG. 4) or may not include all of the components of the ejection detection circuit 531 and/or ejection detection unit 100.

The image output control unit 511 includes a data generator to generate print data, a driving waveform generator to generate driving waveforms to control driving of the recording heads 4, and a data transmitter to transmit print data and head control signals for selecting desired driving signals from the driving waveforms. The image output control unit 511 outputs the driving waveforms, the head control signals, print data and so on to a head driver 51, which is a head driving circuit for driving the recording heads 4 mounted on the carriage 3, to eject liquid droplets from nozzles of the recording heads 4 in accordance with print data.

The encoder analyzer 512 includes a direction detector 520 to detect a movement direction of the carriage 3 from detection signals and a counter 521 to detect a movement amount of the carriage 3.

Based on analysis results transmitted from the encoder analyzer 512, the controller 500 controls driving of the main scan motor 5 via a the main scanning motor driver 513 to control movement of the carriage 3. The controller 500 also controls driving of the sub-scanning motor 16 via a sub scanning motor driver 514 to control feeding of the sheet 10.

In detection of ejection or non-ejection of droplets from the recording heads 4, the main control unit 500A of the controller 500 controls the recording heads 4 to move and eject droplets from desired nozzles of the recording heads 4, and determines droplet ejection states based on detection signals from the ejection detection circuit 531. Such detection can occur while the sheet 10 is conveyed or while sheet conveyance is stopped, but printing is not performed.

Next, an exemplary embodiment of this disclosure is described with reference to FIGS. 4 to 8.

Figure 5A:
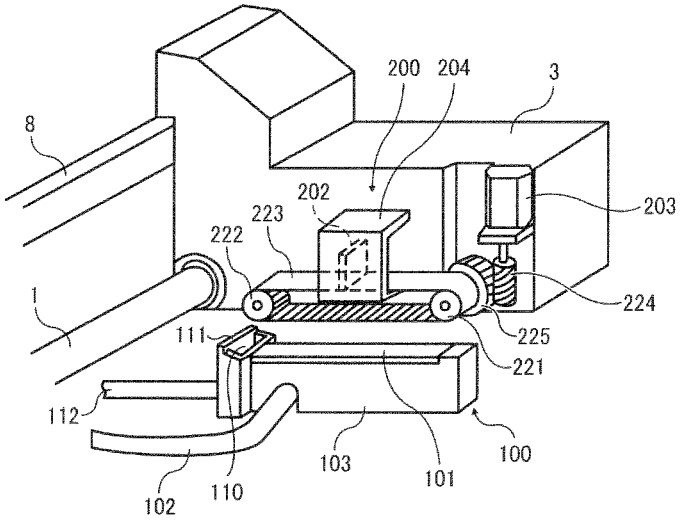
FIGS. 5A and 5B are partial perspective views of the carriage section and the ejection detection unit according to an exemplary embodiment of the present disclosure.
Figure 5B:
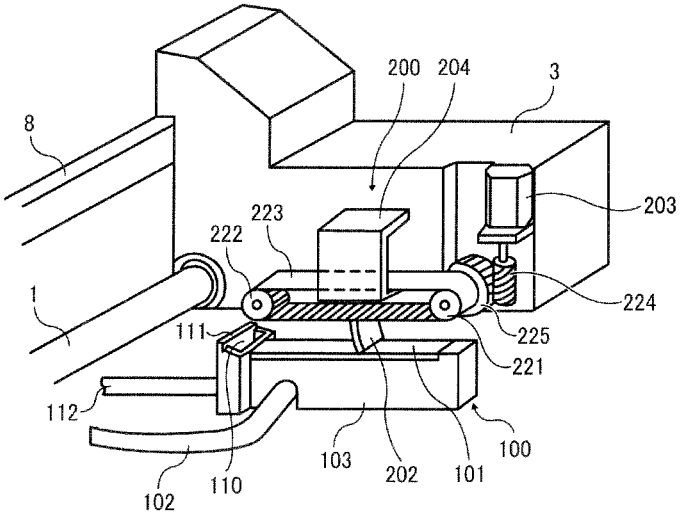
Figure 6:
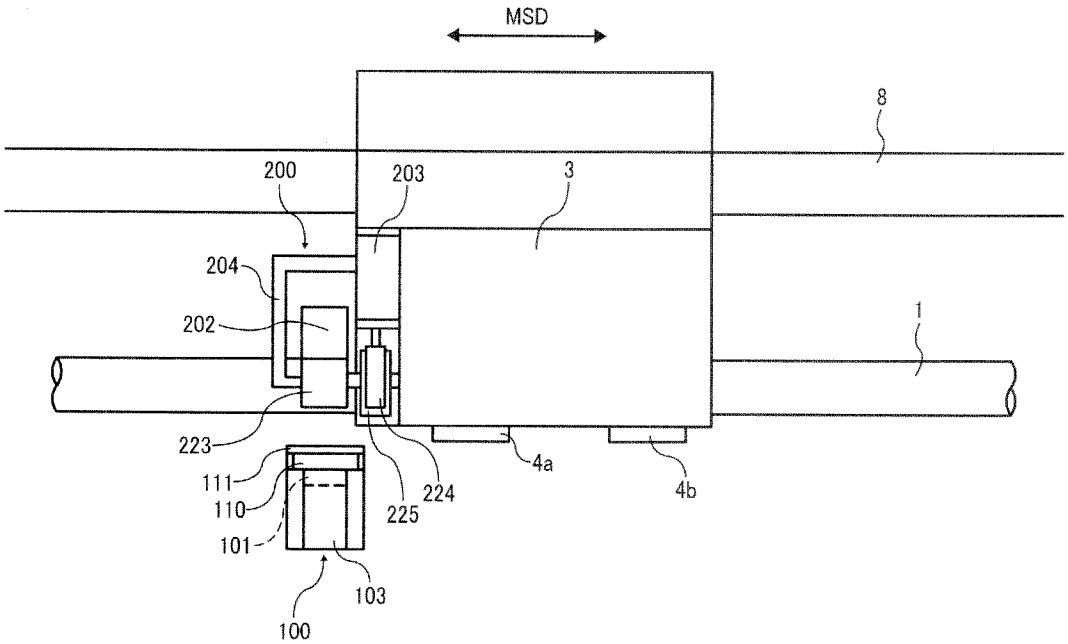
FIG. 6 is a partial front view of the carriage section and the ejection detection unit according to an exemplary embodiment of the present disclosure.
Figure 7:
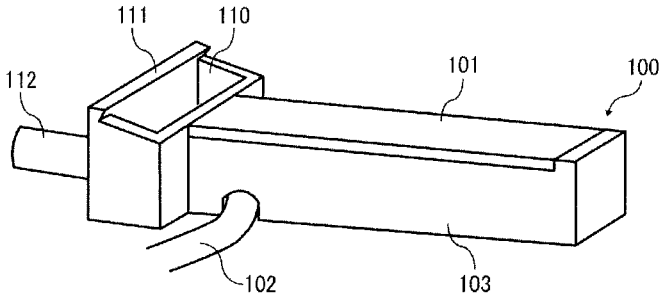
FIG. 7 is a perspective view of the ejection detection unit according to an exemplary embodiment of the present disclosure.
Figure 8:
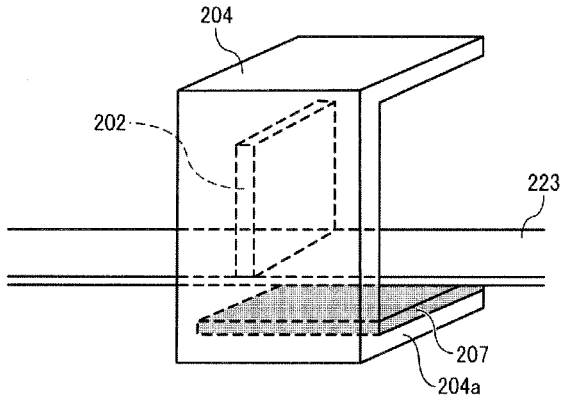
FIG. 8 is a perspective view of a wiper retraction over according to an exemplary embodiment of the present disclosure.

FIG. 4 is a schematic view of lateral faces of a carriage section and an ejection detection unit and a block circuit of an ejection detector according to an embodiment of the present disclosure. FIGS. 5A and 5B are partial perspective views of the carriage section and the ejection detection unit of FIG. 4. FIG. 6 is a partial front view of the carriage section and the ejection detection unit of FIG. 4. FIG. 7 is a perspective view of the ejection detection unit of FIG. 4. FIG. 8 is a perspective view of a wiper retraction cover according to an exemplary embodiment of the present disclosure.

An ejection detection unit 100 includes a holder member 103 and an electrode board 101. The electrode hoard 101 serving as an electrode member is disposed on an upper face of the holder member 103 to oppose a nozzle face 41 of a recording head 4.

The holder member 103 is made of an insulation material, such as plastic.

The electrode board 101 is preferably, for example, a conductive metal plate made of a material which is rustproof and resistant to ink. The electrode board 101 may be, for example, stainless steel (ex. SUS 304) or copper alloy plated with nickel (Ni) or palladium (Pd). A surface of the electrode hoard 101 on which liquid droplets land is preferably finished to be water repellent.

The electrode hoard 101 is electrically connected to a lead cable 102. More specifically, the lead cable 102 is connected to the ejection detection circuit 531. While there is only one line in FIG. 4 leading from the lead cable 102 to the ejection detection circuit 531, it should be understood that such line can represent multiple conductors. For example, one conductor may connect the electrode board 101 to power source 701, and another conductor connects the electrode board 101 to BPF 702.

As illustrated in FIG. 7, the holder member 103 has an opening 110 at a terminal end side in a wiping direction of a wiping member 202. A portion (edge portion) of the holder member 103 forming the opening 110 also forms a wiper cleaner 111 serving as a cleaning member to remove and clean waste liquid (liquid droplets adhering to the wiping member 202) from the wiping member 202.

The holder member 103 has a waste-liquid tube 112 forming a channel connected to a waste liquid tank from a lower side of the opening 110. A suction pump is provided on the channel connected to the waste liquid tank to discard waste liquid accumulated on a bottom portion of the opening 110 into the waste liquid tank.

The carriage 3 includes a cleaning unit 200 including the wiping member 202 to wipe liquid droplets adhering to a surface of the electrode board 101.

The wiping member 202 can be made of, for example, ethylene propylene diene monomer rubber (EPDM). EPDM is not so highly water repellent, and the water repellency of the electrode board 101 can be set to be higher than the water repellency of the wiping member 202. Setting the water repellency of the electrode board 101 to be higher than the water repellency of the wiping member 202 facilitates wiping out of ink from the electrode board 101.

In the example shown in FIG. 5, the wiping member 202 is mounted on a timing belt 223 wound around a driving pulley 221 and a driven pulley 222. When the driving pulley 221 is rotated by the driving motor 203 serving as a driving source mounted on the carriage 3 via a worm gear 224 and a gear 225, the wiping member 202 is circulated with the timing belt 223 in a direction indicated by an arrow A in FIG. 4. Thereby, the wiping member 202 can move between a retracted position as illustrated in FIG. 5A and a wiping position as illustrated in FIG. 5B.

A wiper retraction cover 204 is provided to cover the wiping member 202 at a retracted position as illustrated in FIG. 5A. When the wiping member 202 is not used, the wiping member 202 is accommodated in the wiper retraction cover 204. Such a configuration can prevent a slight amount of waste liquid adhering to the wiping member 202 to be scattered during operation of the carriage 3.

As illustrated in FIG. 8, retraction cover 204 has a lower face serving as a waste-liquid receiver 204*a* to receive waste liquid dripping from the wiping member 202 and an absorbing member 207 is provided on the waste-liquid receiver 204*a* to absorb and retain waste liquid.

Next, an example of the ejection detection circuit 531 is described with reference to FIG. 4.

As illustrated in FIG. 4, the ejection detection circuit 531 has a high-voltage power source 701 to supply a high voltage VE (e.g., 750V) to the electrode board 101. The main control unit 500A control on and off states of the high-voltage power source 701.

The ejection detection circuit 531 also has a band pass filter (BPF) 702 to input signals corresponding to electric changes that occur when liquid droplets land on the electrode board 101, an amplification (AMP) circuit 703 to amplify the signals, and an analog-digital converter (ADC) 704 to convert the amplified signals from analog format to digital format. Resultant converted signals of the ADC 704 are input to the main control unit 500A.

When ejection detection is performed, the nozzle face 41 of one of the recording heads 4 is placed to oppose the electrode board 101. The high voltage VE is supplied to the electrode board 101 to cause a potential difference between the nozzle face 41 and the electrode board 101. At this time, the positive charges on the electrode board 101 (due to the high voltage applied thereto) induce negative charges to accumulate on the nozzle face 41 of the recording head 4.

In such a state, a liquid droplet(s) for ejection detection is (are) ejected from each nozzle of the recording heads 4.

At this time, since liquid droplets are ejected from the nozzle face 41 which is negatively charged, the liquid droplets are also negatively charged. When the liquid droplets negatively charged land on the electrode hoard 101, the voltage of the high voltage VE supplied to the electrode board 101 slightly changes. The hand-pass filter 702 extracts such voltage change (i.e. the fluctuating electric potential on the electrode board) and outputs an analog signal, and the amplification circuit 703 amplifies the signal corresponding to the voltage change. The ADC 704 converts the amplified component from analog format to digital format and inputs the converted data as a measurement result (i.e. detection result) to the main control unit 500A.

The main control unit 500A determines whether the measurement result (corresponding to the voltage change) is greater than a preset threshold value, and if the measurement result is greater than the threshold value, the main control unit 500A determines that a detected nozzle of the recording heads 4 has ejected a liquid droplettor droplets). By contrast, if the measurement result is not greater than the threshold value, the main control unit 500A determines that a detected nozzle of the recording heads 4 has not ejected the expected liquid droplet(s).

In this exemplary embodiment, since one or more liquid droplets are ejected from each nozzle of the recording heads 4 to land on the electrode hoard 101, it takes approximately 0.5 to 10 msec to determine ejection or non-ejection of a single nozzle. After ejection or non-ejection of all nozzles is determined, the voltage VE supplied to the electrode board 101 is turned into off state.

Figure 9A:
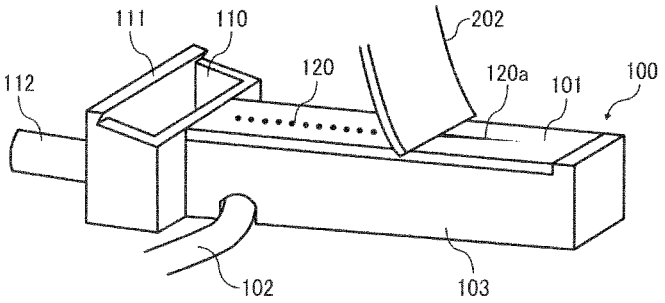
FIGS. 9A, 9B and 9C are perspective views of the ejection detection unit in the wiping operation according to a prim art.
Figure 9B:
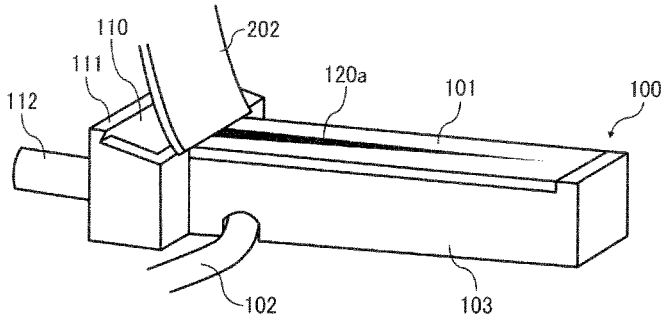
Figure 9C:
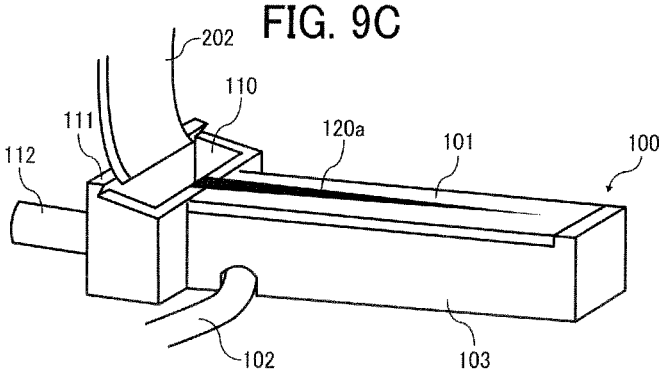

Next, wiping operation of the surface (i.e. ink droplet landing surface) of the electrode board 101 by the wiping member 202 of the cleaning unit 200 is explained with reference to FIGS. 9A, 9B and 9C. FIGS. 9A, 9B and 9C are perspective views of the ejection detection unit in the wiping operation according to a prior art.

First, the driving motor 203 of the cleaning unit 200 is driven to move the wiping member 202, and the ink 120 which was ejected to the electrode board 101 is wiped by the wiping member 202, as illustrated in FIG. 9A.

At this time, some of the wiped ink 120 is discharged into the opening 110 as illustrated in FIG. 9B, and the ink adhering to the wiping member 202 is scraped off with the wiper cleaner 111 as illustrated in FIG. 9C.

However, the amount of ink ejected at the time of the usual ejection detection is a very small quantity, and in some instances, the ink 120*a* is not wiped completely and is extended thinly on the electrode board 101 as illustrated in FIGS. 9B and 9C.

Such ink 120*a* is so thin that the ink is easy to dry and adheres to the electrode board 101 in short time. And when wiping operation is repeated, the ink which adhered accumulates on the surface (i.e. ink droplet landing surface) of the electrode board 101 gradually.

Thus, when ink accumulates on the electrode hoard 101, the surface of an ink accumulation is in the rough state, distance between the surface and the nozzle face 41 is not even and detection performance deteriorates.

Further, when the surface of the ink accumulation becomes very near to the nozzle face 41, the ejection droplets used for ejection detection operation rebound from the ink accumulation and adhere to the nozzle face 41, and these adhering droplets become a cause of unusual ejection, such as non-ejection or ejection direction bend. In addition, the ink accumulation advances and rubs the nozzle face 41 of the recording head 4 in some instances, and unusual ejection is caused because the ink accumulation destroys an ink meniscus or enters in the nozzle.

Then, in the present disclosure, after ejecting a small quantity of ink to the electrode board 101 for ejection detection and before performing wiping operation by the wiping member 202 a relatively greater quantity of, liquid droplets for cleaning (e.g., a predetermined quantity more than quantity of ink ejected for ejection detection on the electrode board 101) are ejected in the ejection detection position. In this way, the electrode board 101 is cleaned with the liquid of relatively greater quantity for cleaning and is wiped with wiping member 202. This operation is called "an ejecting for cleaning", and the liquid droplets for cleaning may be droplets of ink.

Here, as for the predetermined quantity of the liquid droplets (e.g., total volume of liquid droplets which are ejected) for cleaning, it is desirable that liquid of the predetermined quantity can maintain a droplet form on the electrode board until wiping by the wiping member 202 is completed or performed, and it is desirable that the metal surface of the electrode board 101 is restored or exposed (i.e. without ink thereon) after wiping.

Figure 10:
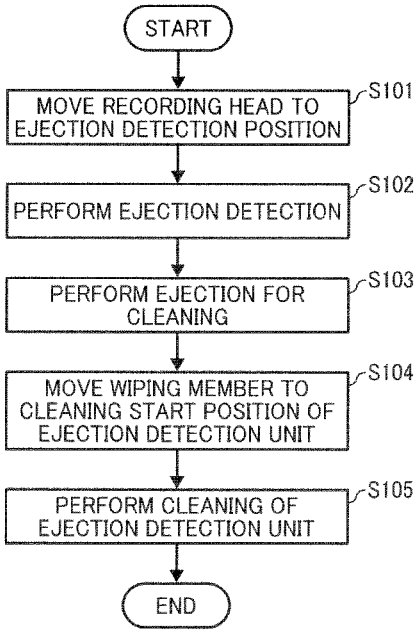
FIG. 10 is a flowchart of ejection detection control and cleaning control performed by a controller according to an exemplary embodiment of the present disclosure.

Next, ejection detection control and cleaning control performed by a controller according to an exemplary embodiment of the present disclosure is described with reference to the flowchart of FIG. 10.

When the ejection detection operation is started, the recording heads 4 are moved to the ejection detection position first (S101), and ejection detection is performed (S102). In this ejection detection, each of the nozzles in a predetermined nozzle row ejects droplet(s) to the electrode board 101 in sequence (i.e. one nozzle followed by another nozzle, and so on). As for the number of ejection droplet per one nozzle, in order to enlarge an electrical potential change, it is desirable to carry out continuation ejection of two or more droplets. At this time, because the voltage of the electrode board 101 changes with the ejected droplet(s) as described above, the electrical change is detected and the existence of ejected droplet(s) is judged.

Here, it is desirable that an ejection position (i.e. position on the electrode hoard 101 at which the ejected liquid droplet lands) is placed in an approximately central portion of the short side direction of the electrode hoard 101 so that the liquid does not spill from the side end of the electrode board 101 at the time of wiping by the wiping member 202.

However, when the recording head has two or more nozzle rows like the recording head 4 described above and the nozzle rows are placed close, it is desirable to perform ejection detection of each nozzle row in the position where the center between the nozzle rows is placed near the center of the electrode board 101. In this way, because the movement time of a recording head is reduced even if small, it is possible to shorten ejection detection time.

On the other hand, when the space between nozzle rows is large, the recording head is moved for every nozzle row so that the nozzle row which performs ejection detection is placed in approximately the center of the electrode hoard 101 and ejection detection of the each nozzle row is performed.

And, after ejection detection is performed, ejection for cleaning which carries out ejection of the ink droplets of the amount of ejection for cleaning (e.g., predetermined quantity) on the electrode hoard 101 is performed by nozzles of the nozzle row which performed the ejection detection concerned (S103). At this time, it is desirable to eject simultaneously from all the channels (nozzles), and to shorten the time which ejection for cleaning takes.

Subsequently, the wiping member 202 is moved to the wiping start position of the ejection detection unit 100 (S104), and the surface of the electrode board 101 is wiped and cleaned by the wiping member 202 according to driving the motor 203 (S105).

At this time, if ink droplets on the electrode board are only ink droplets for ejection detection, the ink droplets are only extended very thinly according to wiping as described above. On the other hand, in ejecting a lot of ink droplets for cleaning (liquid droplets for cleaning) like this embodiment, because the effect of washing with ink liquid occurs, even if there is some ink accumulation, the ink accumulation is discharged together.

Thereby, the electrode board 101 can be kept clean for a long period, and normal ejection detection operation can be performed for a long time.

Then, the wiping member 202 is moved to a position in readiness, and ejection detection operation is ended.

In the above-described exemplary embodiment, a serial-type image forming apparatus using the carriage 4 which has the recording heads 4 and reciprocates in a direction perpendicular to the sheet conveyance direction is described as an example of an image forming apparatus. However, the image forming apparatus may be a line-type image forming apparatus using the sheet width head arranged in the position which is opposite an image forming surface of a sheet conveyance path. When applied to line-type image forming apparatus, the electrode board 101 is arranged to the region which correspond to the full width of a line-head. Since the electrode board 101 always keeps the position corresponding to the line-head, it is not necessary to move the head to the ejection detection position of the electrode board 101.

Figure 11A:
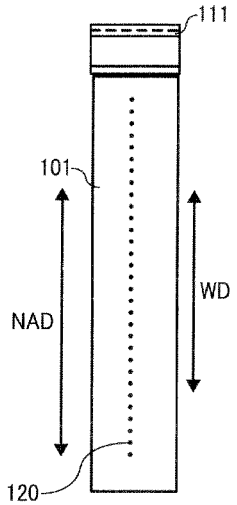
FIGS. 11A and 11B are plan views of an area on the electrode hoard where ejection detection and ejection for cleaning are performed according to an exemplary embodiment of the present disclosure.
Figure 11B:
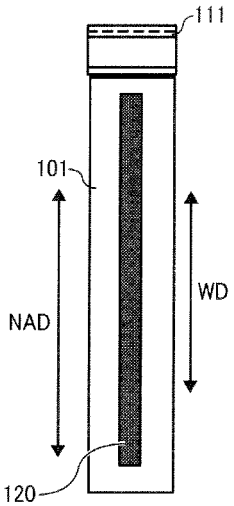

Next, the area where ejection for cleaning is performed according to an exemplary embodiment of the present disclosure is described with reference to FIGS. 11A and 11B. FIGS. 11A and 11B are plan views of an ejection area on the electrode hoard according to an exemplary embodiment of the present disclosure.

In this embodiment, after ejecting ink 120 in the approximately central portion of the electrode hoard 101 at the time of discharge detection as illustrated in FIG. 11A, ejection of liquid droplets for cleaning is performed to the area (ejection area) 121 which covers the ink droplets ejected at the time of ejection detection as shown in FIG. 11B.

That is, in the case of serial-type image forming apparatus which has the recording heads 4 and the electrode board 101, which can move relatively in a direction perpendicular to the nozzle array direction, the ejection for cleaning is performed in an area larger than the landing area of ink droplets for ejection detection which detects the existence of droplet ejection.

Then, the wiping member 202 is moved in a wiping direction indicated by an arrow WD in FIGS. 11A and 11B parallel to the nozzle array direction NAD to wipe the liquid droplets 120 on the electrode board 101. Thereby, an accumulation of solidified waste liquid (ink) can be prevented in the wide area.

Figure 12:
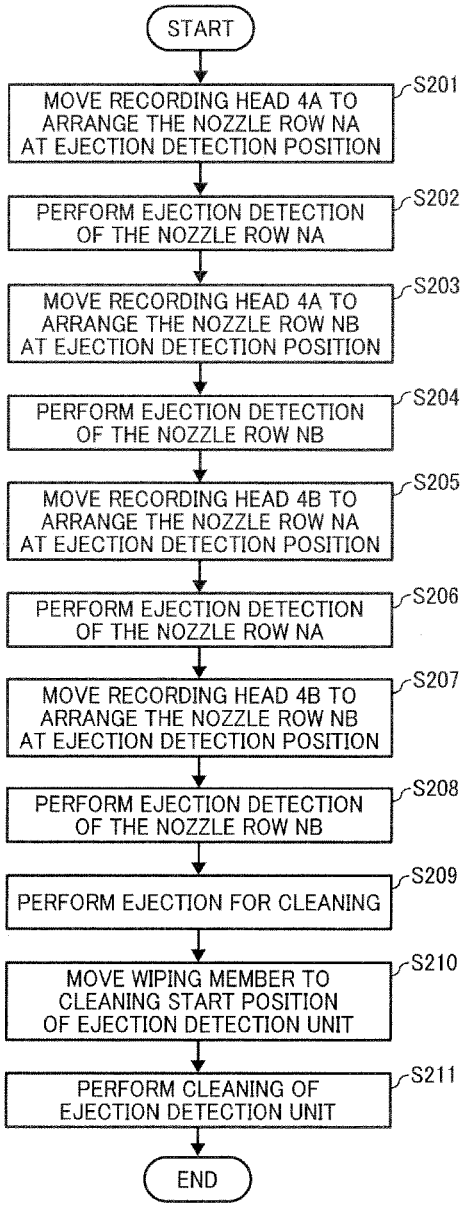
FIG. 12 is a flowchart of ejection detection control and cleaning control performed by a controller according to an exemplary embodiment of the present disclosure.

Next, ejection detection control and cleaning control performed by a controller according to an exemplary embodiment of the present disclosure is described with reference to the flowchart of FIG. 12.

First, the nozzle row Na of the recording head 4*a* is moved to the ejection detection position (S201), and ejection detection is performed (S202). Then, the nozzle row Nb of the recording head 4*a* is moved to the ejection detection position (S203), and ejection detection is performed (S204). Next, the nozzle row Na of the recording head 4*b* is moved to the ejection detection position (S205), and ejection detection is performed (S206). Then, the nozzle row Nb of the recording head 4*b* is moved to the ejection detection position (S207), and ejection detection is performed (S208).

After ejection detection is performed, ejection for cleaning is performed by nozzles of the nozzle row Nb of the recording head 4*b* for which ejection detection was last performed (S209). Subsequently, the wiping member 202 is moved to the wiping start position of the ejection detection unit 100 (S210), and the surface of the electrode hoard 101 is wiped and cleaned by the wiping member 202 (S211).

That is, the image forming apparatus illustrated by FIG. 2, which was discussed above, has two recording heads 4*a* and 4*b*, and each head 4*a* and 4*b* has a plurality of nozzle rows Na and Nb, respectively.

Here, the purpose of performing ejection detection is to check whether there are any abnormalities in each of all the nozzles, and when all the nozzles are normal or at least in the range of the abnormalities of the level for which an image is not affected, printing is performed and good printed matter is obtained.

Thus, in order of the nozzle rows Na of the recording head 4*a*, Nb of the recording head 4*a*, Na of the recording head 4*b*, and Nb of the recording head 4*b*, each nozzle row is moved to the ejection detection position one by one, and ejection detection is performed.

After ejection detection of the last nozzle row is performed, ejection for cleaning is performed ejecting liquid droplets for cleaning by the nozzles of the last nozzle row With constituting in this way, the useless ink consumption for performing cleaning of the electrode hoard 101 can be held down.

Figure 13:
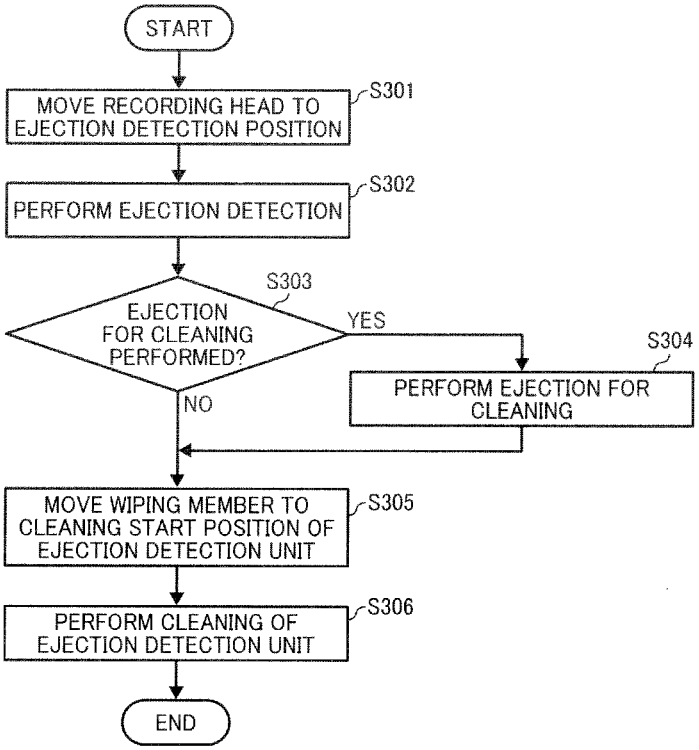
FIG. 13 is a flowchart of ejection detection control and cleaning control performed by a controller according to an exemplary embodiment of the present disclosure.

Next, ejection detection control and cleaning control performed by a controller according to exemplary embodiment of the present disclosure is described with reference to the flowchart of FIG. 13.

In this disclosure, the recording heads 4 are moved to the ejection detection position (S301), and ejection detection is performed (S302). Then, it is determined whether ejection for cleaning is performed or not (S303).

At this time, if it is determined that ejection for cleaning is performed, after carrying out ejection of liquid droplets for cleaning, the wiping member 202 is moved to the wiping start position of the ejection detection unit 100 and the surface of the electrode board 101 of the ejection detection unit 100 is wiped and cleaned. And if it is determined that ejection for cleaning is not to be performed, the wiping member 202 is moved to the wiping start position of the ejection detection unit 100 directly and the surface of the electrode board 101 of the ejection detection unit 100 is not wiped and cleaned.

That is, in this disclosure, cleaning of ejection detection unit can be performed, after choosing whether to perform ejection for cleaning.

Here, because the amount of ink which is ejected by ejection detection is very little, even if the ink is wiped by the wiping member and extended thinly, the ink accumulation does not immediately reach the level which affects ejection detection performance. Therefore, if ejection for cleaning is performed after every ejection detection, the amount of consumption of useless ink increases.

Accordingly, useless ink consumption can be reduced because ejection for cleaning is performed when the ink accumulates to some extent.

Here, other examples of the condition to distinguish whether to perform ejection for cleaning are explained.

In the first example, it is distinguished (or determined) whether to perform ejection for cleaning, based on whether the elapsed time from the last ejection detection operation time or the elapsed time from the starting operation time of the image forming apparatus reaches the threshold value defined beforehand.

Namely, the elapsed time from the last ejection detection (or the last ejection detection operation) is measured, and performing ejection for cleaning is determined by the elapsed time (e.g., for a week), or whenever predetermined time passes after the image forming apparatus begins operation, ejection detection is performed for every certain fixed period (e.g., every month).

Moreover, ejection for cleaning may not be performed for every certain fixed period. Namely, ejection for cleaning may be performed with a long time interval in the beginning (until operation time of the image forming apparatus reaches the predetermined time defined beforehand), and may be performed with a short time interval when the operation time becomes long (when operation time reaches the predetermined time defined beforehand).

In the second example, it is distinguished (or determined) whether to perform ejection for cleaning, based on whether the number of times to perform ejection detection operation reaches the threshold value defined beforehand (number of times of predetermined).

For example, when ejection detection operation is performed fifty times, ejection for cleaning is performed once. Or ejection for cleaning is performed once per one hundred times of ejection detection operation in the beginning (until operation time of the image forming apparatus reaches the predetermined time defined beforehand), and is performed once per fifty times of ejection detection operation when the operation time becomes long (when operation time reaches the predetermined time defined beforehand).

In the third example, the detection result (by sensors 517) of the environmental condition (at least one of environmental temperature and environmental moisture) of the image forming apparatus is compared with the threshold value beforehand defined, and it is distinguished (determined) whether to perform ejection for cleaning based on whether the environmental condition reaches the threshold value defined beforehand.

For example, when determining with environmental temperature, ejection for cleaning is performed at the time of 27° C. or more, and it is not performed at less than 27° C. Or, when determining with environmental moisture, ejection for cleaning is performed at the time of 30% Rh or less, and it is not performed at more than 30% Rh.

In the fourth example, the detection result of the environmental condition (at least one of environmental temperature and environmental moisture) of the image forming apparatus is compared with the threshold value beforehand defined, and it is distinguished (determined) whether to perform ejection for cleaning, based on whether the number of times (the accumulation number of times) that the environmental condition reached the threshold value becomes the predetermined number of times, or based on whether the days (accumulation days) that the environmental condition reached the threshold value becomes the predetermined days.

For example, ejection for cleaning is performed, when high temperature days which is more than 28° C. accumulate in ten days or ejection for cleaning is performed, when low humidity days which is less than 30% Rh accumulate in five days.

In the each above-described exemplary embodiments of disclosure, the ink droplet landing member is explained in the example which is the electrode board. However, the ink droplet landing member may be a resistor (resistance component) and ejection detection can be performed like above-described disclosure, by detecting the resistance change between the both ends of the resistor by ink droplet landing.

It is to be noted that the above-described control of droplet ejection detection operation can be performed by a computer according to a program stored in, e.g., the ROM of the controller. The program may be provided as a recording medium storing the program therein or may be provided so as to be downloaded through a network, e.g., the Internet.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a recording head including a plurality of nozzles to eject respective droplets;

an ejection detector to detect one or more droplets ejected from the recording head, the ejection detector including a droplet landing member, on which a droplet ejected from any of the nozzles of the recording head lands, the droplet landing member disposed in an area where the recording head faces, the ejection detector detecting ejection or non-ejection of the droplets by detecting electric change caused by landing of the droplets on the droplet landing member;

a cleaner to clean a droplet landing surface of the droplet landing member of the ejection detector;

a cleaning ejection controller to control the recording head to eject droplets on the droplet landing surface, and the cleaning ejection controller ejects droplets on the droplet landing surface, a quantity of the droplets of which is greater than a quantity of the droplets ejected for detecting ejection or non-ejection of the droplets, to clean the droplet landing surface, before cleaning the droplet landing surface by the cleaner.

2. The image forming apparatus of claim 1, wherein the droplet landing member includes an electrode, and the ejection detector detects ejection or non-ejection of the droplets by detecting electric change of the electrode which is caused by landing of the droplets on the electrode in the state in which potential difference is present between a nozzle face of the recording head and the electrode.

3. The image forming apparatus of claim 1, wherein the droplet landing member includes an resistance component, and the ejection detector detects ejection or non-ejection of the droplets by detecting change of resistance value which caused by landing of the droplets on the resistance component.

4. The image forming apparatus of claim 1, wherein the recording head and the droplet landing member are configured to move relatively in a direction perpendicular to the nozzle array direction, and ejection of droplet for cleaning is performed in an area larger than a landing area of droplets for detecting ejection or non-ejection of the droplets.

5. The image forming apparatus of claim 1, wherein the cleaner cleans the droplet landing surface after detecting ejection or non-ejection of the droplets about all the nozzles of the recording head.

6. The image forming apparatus of claim 1, wherein the cleaning ejection controller controls the recording head to cause the recording head to eject droplets for cleaning when a predetermined condition is met.

7. The image forming apparatus of claim 6, wherein the cleaning ejection controller controls the recording head to cause the recording head to eject droplets for cleaning when an elapsed time from a last ejection for detecting ejection or non-ejection or an elapsed time from the starting time of droplets ejection operation of the image forming apparatus reaches a threshold value defined beforehand.

8. The image forming apparatus of claim 6, wherein the cleaning ejection controller controls the recording head to cause the recording head to eject droplets for cleaning when a number of times to perform ejection detection operation reaches a threshold value defined beforehand.

9. The image forming apparatus of claim 6, wherein the cleaning ejection controller controls the recording head to cause the recording head to eject droplets for cleaning when at least one of environmental temperature and environmental moisture reaches a threshold value defined beforehand.

10. An image forming apparatus of claim 6, wherein the cleaning ejection controller controls the recording head to cause the recording head to eject droplets for cleaning when an accumulation number of times or accumulation days that at least one of environmental temperature and environmental moisture reaches a threshold value defined beforehand reaches a threshold value defined beforehand.

* * * * *

UNITED STATES PATENT AND TRADEMARK OFFICE

CERTIFICATE OF CORRECTION

PATENT NO. : 9,028,039 B2
APPLICATION NO. : 14/507929
DATED : October 7, 2014
INVENTOR(S) : Shingo Masaoka, Shotaro Takeuchi and Masahiko Hisada It is certified that error appears in the above-identified patent and that said Letters Patent is hereby corrected as shown below:

Add item (30) to the Title page of the patent as follows:

-- (30) Foreign Application Priority Data:
Oct. 7, 2013 (JP) 2013-210064 --.

Signed and Sealed this
Ninth Day of February, 2016

Michelle K. Lee

Michelle K. Lee
*Director of the United States Patent and Trademark Office*